US009577329B2

(12) United States Patent
Yona

(10) Patent No.: US 9,577,329 B2
(45) Date of Patent: Feb. 21, 2017

(54) ULTRA-BROADBAND ANTENNA WITH CAPACITIVELY COUPLED GROUND LEG

(71) Applicant: GALTRONICS CORPORATION LTD., Tiberias (IL)

(72) Inventor: Haim Yona, Givat Avni (IL)

(73) Assignee: GALTRONICS CORPORATION, LTD., Tiberias (IL)

( * ) Notice: Subject to any disclaimer, the term of this patent is extended or adjusted under 35 U.S.C. 154(b) by 302 days.

(21) Appl. No.: 14/141,178

(22) Filed: Dec. 26, 2013

(65) Prior Publication Data

US 2014/0184467 A1 Jul. 3, 2014

Related U.S. Application Data

(60) Provisional application No. 61/746,681, filed on Dec. 28, 2012.

(51) Int. Cl.

| | |
|---|---|
| ***H01Q 9/28*** | (2006.01) |
| ***H01Q 5/00*** | (2015.01) |
| ***H01Q 9/40*** | (2006.01) |
| ***H01Q 5/328*** | (2015.01) |

(52) U.S. Cl.

CPC ..... *H01Q 5/0093* (2013.01); *H01Q 5/328* (2015.01); *H01Q 9/28* (2013.01); *H01Q 9/40* (2013.01)

(58) Field of Classification Search

CPC ..... H01Q 5/328; H01Q 5/0093; H01Q 9/40; H01Q 9/28

See application file for complete search history.

(56) References Cited

U.S. PATENT DOCUMENTS

| | | | | |
|---|---|---|---|---|
| 4,630,060 | A * | 12/1986 | Newcomb | H01Q 5/321 343/722 |
| 2007/0262906 | A1* | 11/2007 | Haim | H01Q 1/2266 343/700 MS |
| 2009/0237314 | A1* | 9/2009 | Lalezari | H01Q 21/10 343/721 |
| 2011/0273361 | A1* | 11/2011 | Autti | H01Q 1/243 343/904 |

* cited by examiner

*Primary Examiner* — Sue A Purvis
*Assistant Examiner* — Noel Maldonado
(74) *Attorney, Agent, or Firm* — Lorenz & Kopf, LLP.

(57) ABSTRACT

An antenna including a ground plane, a broadband radiating element mounted on the ground plane and including a feed point, the feed point having a first impedance, a feed for feeding the broadband radiating element at the feed point, the feed having a second impedance and a ground leg extending between the broadband radiating element and the ground plane for impedance matching the first impedance to the second impedance, the ground leg being capacitively coupled to the broadband radiating element.

12 Claims, 9 Drawing Sheets

ULTRA-BROADBAND ANTENNA WITH CAPACITIVELY COUPLED GROUND LEG

REFERENCE TO RELATED APPLICATIONS

Reference is hereby made to U.S. Provisional Patent Application 61/746,681, entitled NOVEL GAMMA MATCHING CIRCUIT TO ACHIEVE ULTRA BROADBAND, OMNI ANTENNA FOR INDOOR/OUTDOOR APPLICATIONS, filed Dec. 28, 2012, the disclosure of which is hereby incorporated by reference and priority of which is hereby claimed pursuant to 37 CFR 1.78(a) (4) and (5)(i).

FIELD OF THE INVENTION

The present invention relates generally to antennas and more particularly to broadband antennas.

BACKGROUND OF THE INVENTION

Various types of broadband antennas are known in the art.

SUMMARY OF THE INVENTION

The present invention seeks to provide a compact, ultra-broadband antenna for use in wireless communication.

There is thus provided in accordance with a preferred embodiment of the present invention an antenna including a ground plane, a broadband radiating element mounted on the ground plane and including a feed point, the feed point having a first impedance, a feed for feeding the broadband radiating element at the feed point, the feed having a second impedance and a ground leg extending between the broadband radiating element and the ground plane for impedance matching the first impedance to the second impedance, the ground leg being capacitively coupled to the broadband radiating element.

Preferably, the broadband radiating element includes a broadband vertically polarized conical monopole radiating element.

Preferably, the ground plane includes an aperture adapted for insertion therethrough of the feed.

Preferably, the feed is galvanically connected to the feed point of the broadband radiating element.

In accordance with a preferred embodiment of the present invention, the ground leg includes a first end and a second end, the first end being connected to the broadband radiating element and the second end being connected to the ground plane.

In accordance with a further preferred embodiment of the present invention, the antenna also includes at least one lumped reactive element disposed within the ground leg.

Preferably, the at least one lumped reactive element is serially disposed within the ground leg.

Preferably, the at least one lumped reactive element includes a capacitor.

Additionally or alternatively, the at least one lumped reactive element includes an inductive coil.

Preferably, the broadband radiating element operates over a frequency range of 380-6000 MHz.

Preferably, at least one of the first and second ends of the ground leg is respectively galvanically connected to the broadband radiating element and to the ground plane.

Additionally or alternatively, at least one of the first and second ends of the ground leg is respectively capacitively connected to the broadband radiating element and to the ground plane.

Preferably, the ground leg includes protruding stubs.

Preferably, the capacitive coupling between the ground leg and the broadband radiating element is functional to match the first impedance to the second impedance.

Preferably, the capacitive coupling is functional to reduce a voltage standing wave ratio of the antenna.

In accordance with a preferred embodiment of the present invention the broadband vertically polarized conical monopole radiating element includes an upper conductive cylindrical element, a lower conductive conical element partially overlapping with the upper conductive cylindrical element, the lower conductive conical element having an apex, the feed point being located at the apex, an inner dielectric spacer element supporting the upper conductive cylindrical element and an outer supporting dielectric stand supporting the upper conductive cylindrical element and the lower conductive conical element.

Further in accordance with the preferred embodiment of the present invention, the ground leg includes a first square portion disposed on the ground plane and preferably secured thereto by way of a screw, a second tapered portion extending from the first square portion at an acute angle with respect to a first plane defined by the ground plane, a third portion extending from the second tapered portion and bent at an acute angle thereto, the third portion being generally parallel to the lower conductive conical element and terminating in a short fourth portion, the short fourth portion lying in a second plane parallel to the first plane and offset therefrom, a fifth elongate portion extending perpendicularly from the fourth portion and including a first protrusion and a second protrusion extending perpendicularly therefrom, the first and second protrusions being spaced at intervals along the fifth elongate portion and being mutually parallel, the fifth elongate portion also including an orthogonally bent terminal section, a sixth portion extending parallel to and being offset from the orthogonally bent terminal section, the sixth portion forming an extruding end segment of a seventh inverted L-shaped portion, the seventh inverted L-shaped portion being supported by an outer wall of the upper conductive cylindrical element and a capacitor bridging the orthogonally bent terminal section and the sixth portion, the capacitor being secured by way of two conductive legs respectively inserted in the orthogonally bent terminal section and the sixth portion.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
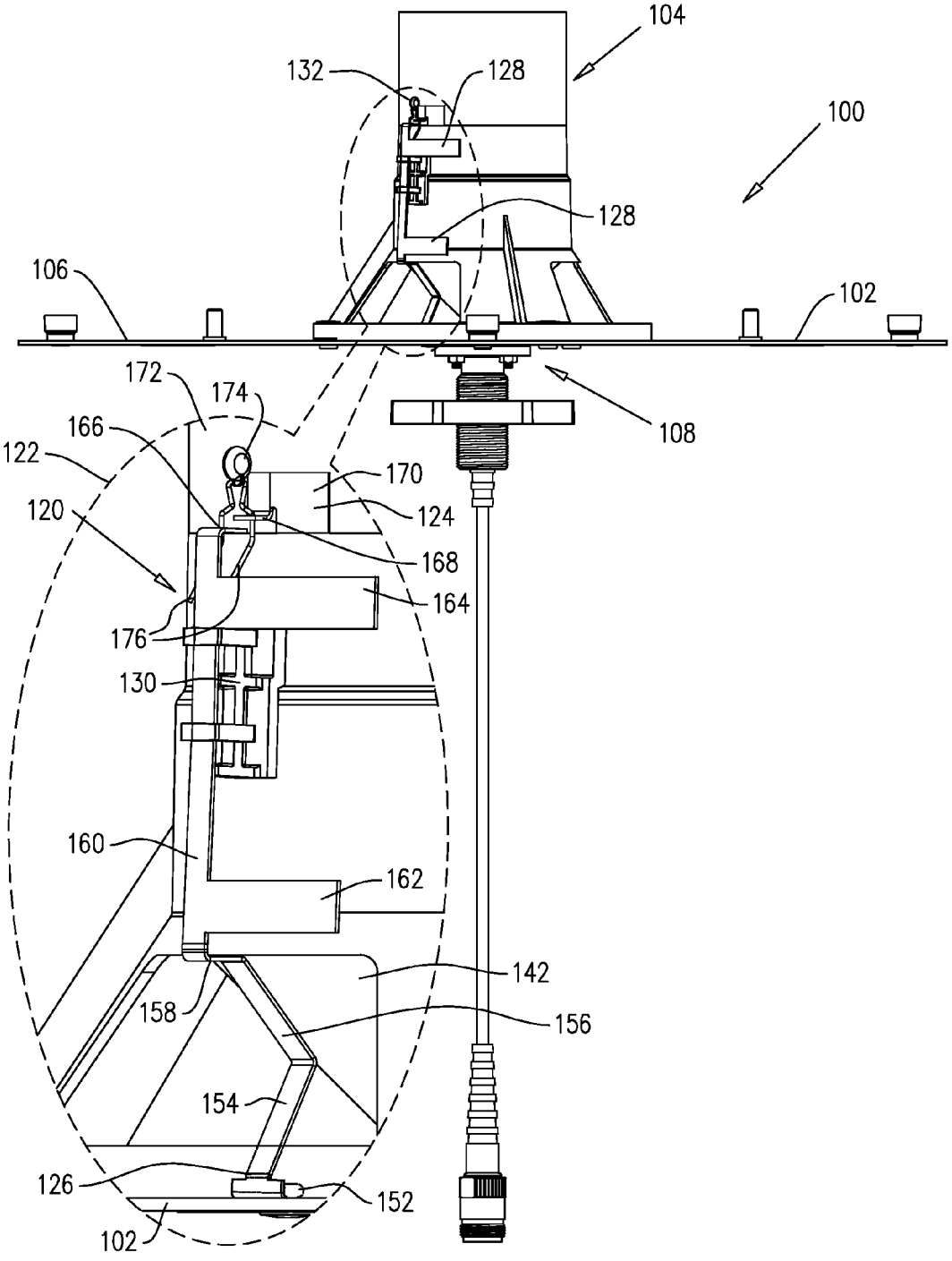
FIGS. 1A, 1B and 1C are simplified respective side, top and perspective view illustrations of an antenna constructed and operative in accordance with a preferred embodiment of the present invention.
Figure 1B:
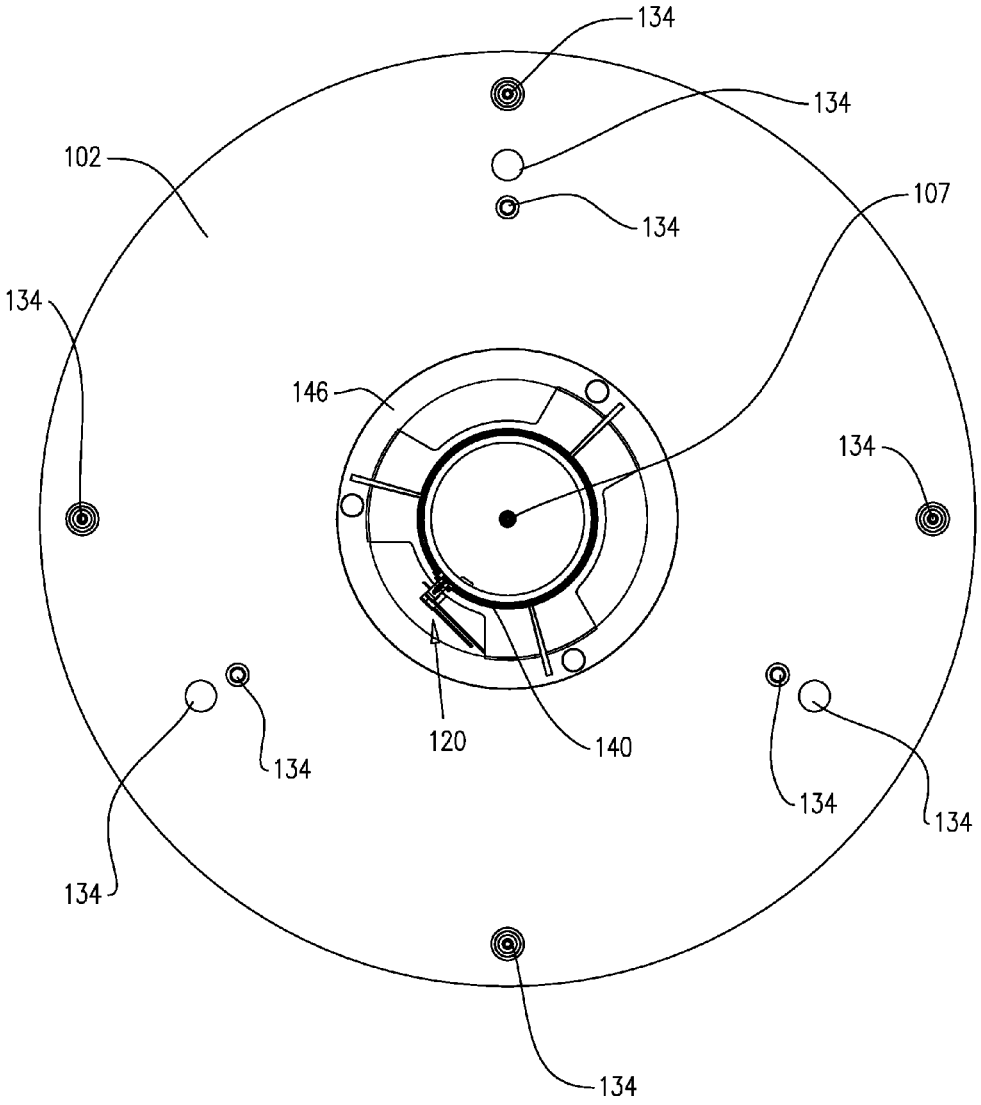
Figure 1C:
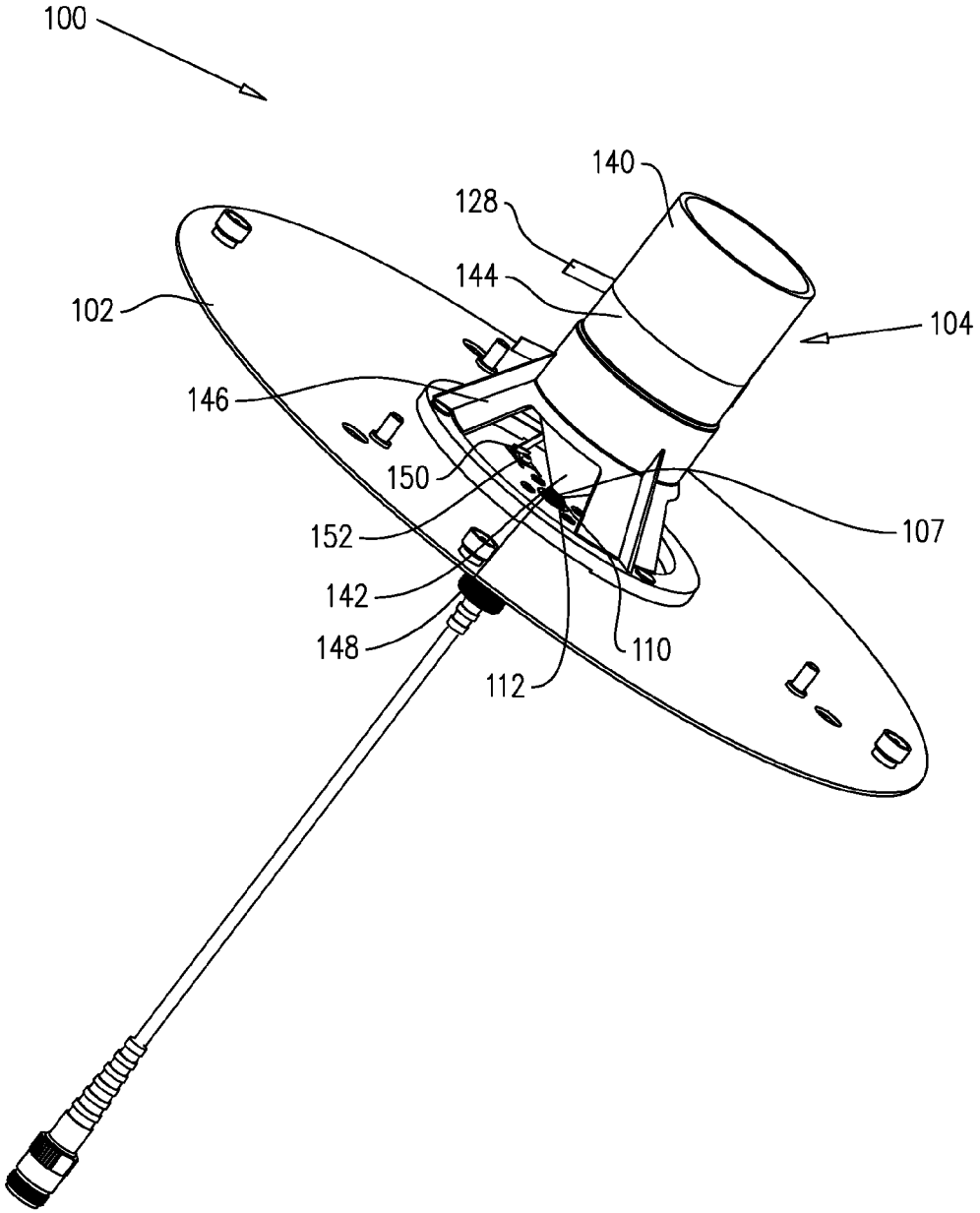

Reference is now made to FIGS. 1A, 1B and 1C, which are simplified respective side, top and perspective view illustrations of an antenna constructed and operative in accordance with a preferred embodiment of the present invention.

As seen in FIGS. 1A-1C, there is provided an antenna 100 preferably including a ground plane 102 and a broadband radiating element 104 mounted thereon. Broadband radiating element 104 is preferably embodied as a broadband vertically polarized conical monopole radiating element 104, preferably disposed on a surface 106 of ground plane 102.

Broadband radiating element 104 includes a feed point 107, at which feed point 107 broadband radiating element 104 is preferably fed by way of a feed 108. As seen most clearly in FIG. 1C, feed 108 preferably comprises an input port 110 preferably galvanically connected to feed point 107 by way of an aperture 112 formed in ground plane 102. It is appreciated, however, that the illustrated arrangement of feed 108 with respect to broadband radiating element 104 is exemplary only and that other suitable feed arrangements, as are well known in the art, may alternatively be implemented in antenna 100.

As will be readily understood by one skilled in the art, feed point 107 of broadband radiating element 104 has an associated first impedance and feed 108 has an associated second impedance, which first and second impedances must be mutually well matched in order to facilitate efficient energy transfer therebetween and hence allow broadband operation of antenna 100. It is a particular feature of a preferred embodiment of the present invention that the first impedance of feed point 107 is well matched to the second impedance of the feed 108 due to the provision of a ground leg 120 extending between broadband radiating element 104 and ground plane 102. As seen most clearly at enlargement 122 in FIG. 1A, ground leg 120 preferably has a first end 124, which first end 124 is preferably connected to broadband monopole radiating element 104, and a second end 126, which second end 126 is preferably connected to ground plane 102.

It is a further particular feature of a preferred embodiment of the present invention that ground leg 120 is preferably arranged so as to be capacitively coupled to broadband radiating element 104. As seen most clearly in FIG. 1A, ground leg 120 is preferably located in close proximity to and co-extensive with a portion of broadband radiating element 104, thereby leading to capacitive coupling therebetween. This is in contrast to conventional ground leg matching arrangements, in which the ground leg typically performs impedance matching by way of providing a shunt conductive path between a radiating element and a ground, but does not itself capacitively couple to the radiating element.

As a result of the capacitive coupling between broadband radiating element 104 and ground leg 120, ground leg 120 is functional to significantly improve the impedance match of broadband radiating element to the feed 108 and hence to facilitate ultra-broadband operation of radiating element 104. By way of example only, broadband radiating element 104 may operate over an ultra-broadband frequency range of 380-6000 MHz due to the improved impedance matching provided by the capacitive coupling of ground leg 120 to broadband radiating element 104, whereas in the absence of capacitively coupled ground leg 120 radiating element 104 may have a more limited frequency range spanning only 700-6000 MHz. Ground leg 120 thus serves to create an additional resonant frequency range in antenna 100.

The capacitive coupling between ground leg 120 and broadband radiating element 104 is preferably optimized by way of a plurality of stubs 128 preferably extending outwards from ground leg 120. The strength of the capacitive coupling between ground leg 120 and broadband radiating element 104 may be adjusted by means of modifications to the location and geometry of stubs 128 and of ground leg 120, in accordance with the operating requirements of antenna 100. As seen most clearly at enlargement 122, ground leg 120 may be held in position with respect to broadband radiating element 104 by way of a non-conductive securing element 130. It is understood, however, that the particular configuration of ground leg 120 and stubs 128 shown in FIGS. 1A-1C is exemplary only.

Ground leg 120 is preferably intersected by at least one lumped reactive element, here embodied, by way of example, as a capacitor 132. Capacitor 132 is preferably serially disposed within ground leg 120 between first and second ends 124 and 126 thereof. It is appreciated, however, that capacitor 132 may be disposed, serially or in parallel, at any point along ground leg 120 in accordance with the mechanical design requirements of ground leg 120. It is further appreciated that ground leg 120 may comprise discrete conductive portions bridged by at least one reactive element, as shown in FIGS. 1A-1C, or may be formed as a continuous structure. The at least one reactive element disposed within ground leg 120 may, by way of example, comprise an inductor and a capacitor.

Capacitor 132, in combination with the capacitive coupling provided by capacitively coupled ground leg 120, is functional to advantageously reduce the Voltage Standing Wave Ratio (VSWR) of antenna 100. By way of example only, antenna 100 may operate with a VSWR of less than 3.1:1 over a frequency range of 380-480 MHz and with a VSWR of less than 2:1 over a frequency range of 700-960 MHz, due to the presence of capacitor 132 in capacitively coupled ground leg 120. In the absence of capacitor 132, antenna 100 may operate with a VSWR of greater than 4:1 in the 380-480 MHz frequency range and a VSWR of greater than 2:1 in the 700-960 MHz frequency range. Capacitor 132 may have a capacitance value of approximately 3.3 pF.

In the embodiment of antenna 100 shown in FIGS. 1A-1C, ground leg 120 is shown to be galvanically connected at its first and second ends 124 and 126 to broadband radiating element 104 and ground plane 102 respectively. It is appreciated, however, that ground leg 120 may alternatively be capacitively connected at one or both of its ends to broadband radiating element 104 and ground plane 102 respectively, depending on the impedance matching required to be performed by ground leg 120.

It is thus appreciated that due to the enhanced impedance matching performed by capacitively coupled ground leg 120 including capacitor 132, antenna 100 constitutes an ultra-broadband vertically polarized antenna capable of radiating vertically polarized radio-frequency (RF) signals over an extremely wide frequency range, making antenna 100 particularly well suited for a wide variety of Single Input Single Output (SISO) applications. Broadband radiating element 104 preferably radiates a conical, omnidirectional radiation pattern.

Antenna 100 may be installed on an indoor or outdoor surface. A multiplicity of holes 134 is optionally formed in ground plane 102 in order to facilitate the attachment of antenna 100 to a supporting surface such as a ceiling or wall. Holes 134 may also be used for the optional attachment of a radome to antenna 100.

In accordance with a particularly preferred embodiment of the present invention, broadband vertically polarized conical monopole radiating element 104 preferably comprises an upper conductive cylindrical element 140 and a lower conductive conical element 142. Cylindrical element 140 and conical element 142 are preferably held in a partially overlapping configuration by means of an inner dielectric spacer element 144 and outer supporting dielectric stand 146, as seen most clearly in FIG. 1C. Feed point 107 is preferably located at an apex 148 of lower conductive conical element 142. Broadband vertically polarized conical monopole radiating element 104 is preferably generally of a type described in Chinese Utility Model Application No. 201320043587.5, assigned to the same assignee as the present application and incorporated herein by reference.

It is appreciated, however, that the illustrated embodiment of monopole radiating element 104 is exemplary only and that a variety of other broadband monopole radiating elements are possible and are included in the scope of the present invention. It is further appreciated that the terms 'upper' and 'lower' as used with respect to the relative location of cylindrical and conical elements 140 and 142 are relational only and that the spatial relationship between cylindrical and conical elements 140 and 142 is determined by the orientation at which antenna 100 is mounted.

Further in accordance with a particularly preferred embodiment of the present invention, ground leg 120 preferably comprises a first square portion 150 disposed on ground plane 102 and preferably secured thereto by way of a screw 152. A second tapered portion 154 preferably extends from first square portion 150 at an acute angle with respect to a first plane defined by ground plane 102. Second tapered portion 154 preferably bends at an acute angle to form a third portion 156, which third portion 156 preferably extends generally parallel to lower conductive conical element 142. Third portion 156 preferably terminates in a short fourth portion 158, which short fourth portion 158 preferably lies in a second plane parallel to the first plane and offset therefrom.

A fifth elongate portion 160 preferably extends perpendicularly from fourth portion 158. A first protrusion 162 and a second protrusion 164 preferably extend perpendicularly at intervals along fifth elongate portion 160 and parallel to each other. Fifth elongate portion 160 further preferably includes an orthogonally bent terminal section 166. It is appreciated that first and second protrusions 162 and 164 constitute particularly preferred embodiments of stubs 128.

A sixth portion 168 preferably extends parallel to and offset from terminal section 166. Sixth portion 168 forms an extruding end segment of a seventh inverted L-shaped portion 170, which seventh inverted L-shaped portion 170 is preferably supported by an outer wall 172 of upper conductive cylindrical element 140.

A capacitor 174 preferably bridges orthogonally bent terminal section 166 and sixth portion 168. Capacitor 174 is secured by way of two conductive legs 176 respectively inserted into orthogonally bent terminal section 166 and sixth portion 168. It is appreciated that capacitor 174 is a particularly preferred embodiment of capacitor 132.

Figure 2A:
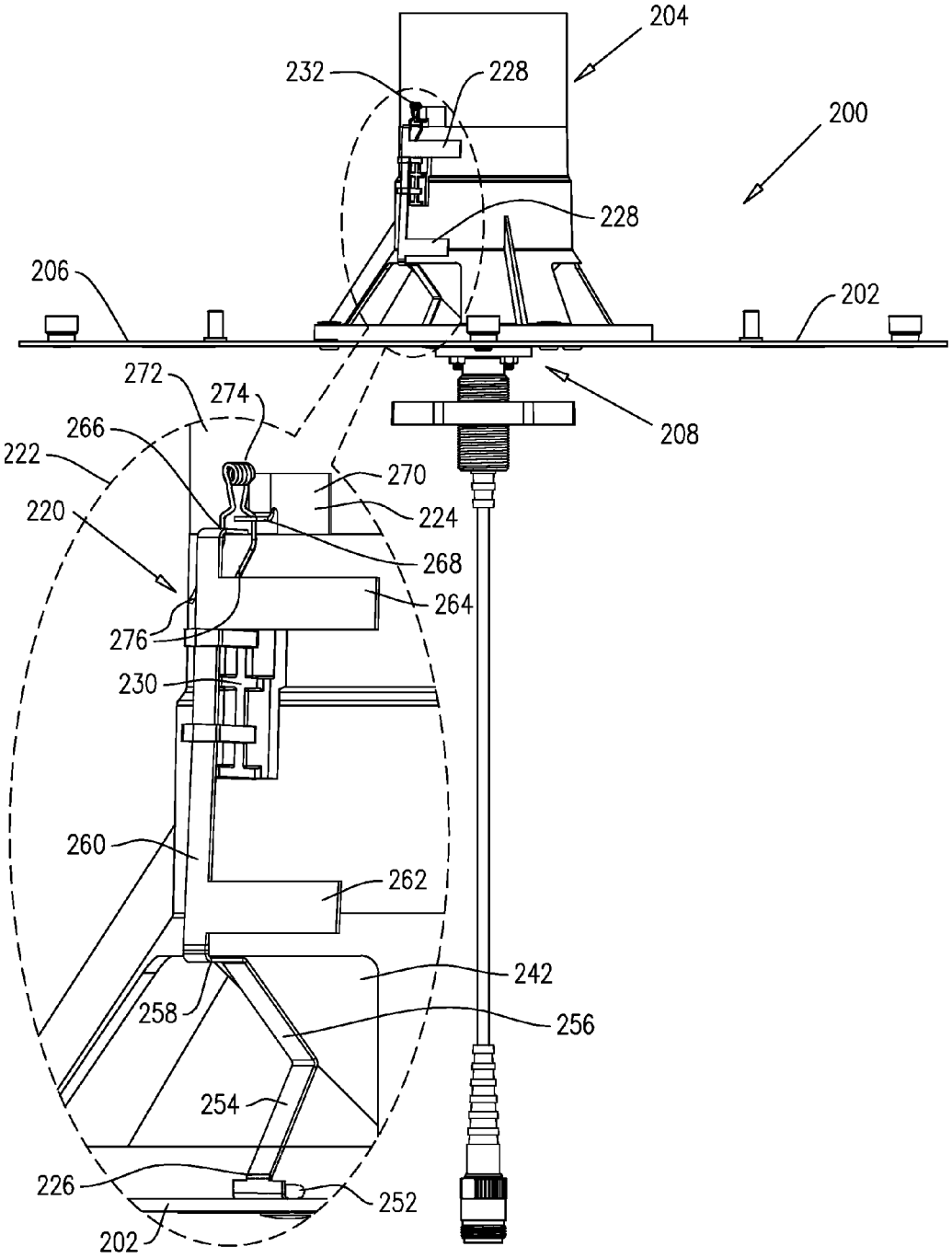
FIGS. 2A, 2B and 2C are simplified respective side, top and perspective view illustrations of an antenna constructed and operative in accordance with another preferred embodiment of the present invention.
Figure 2B:
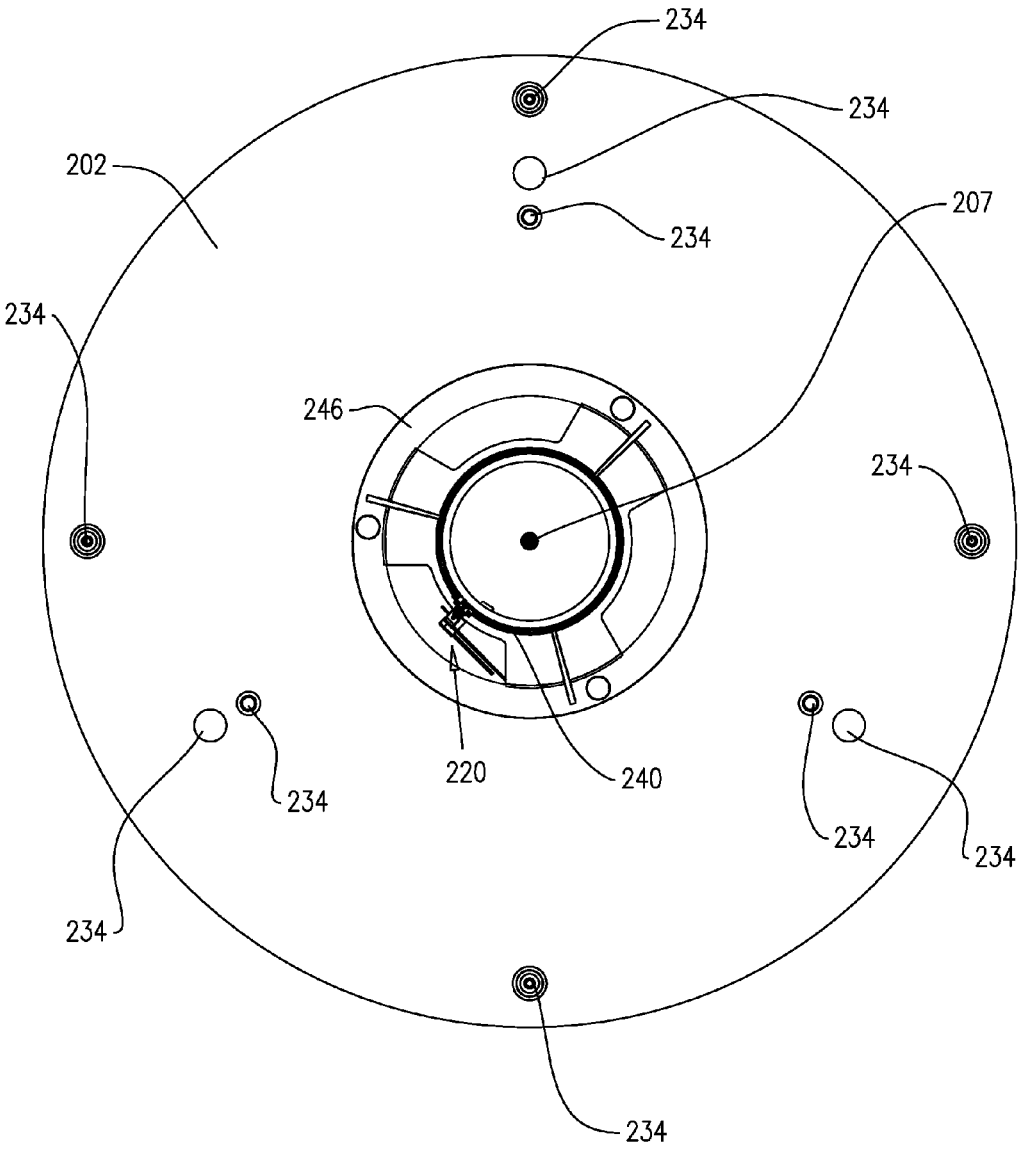
Figure 2C:
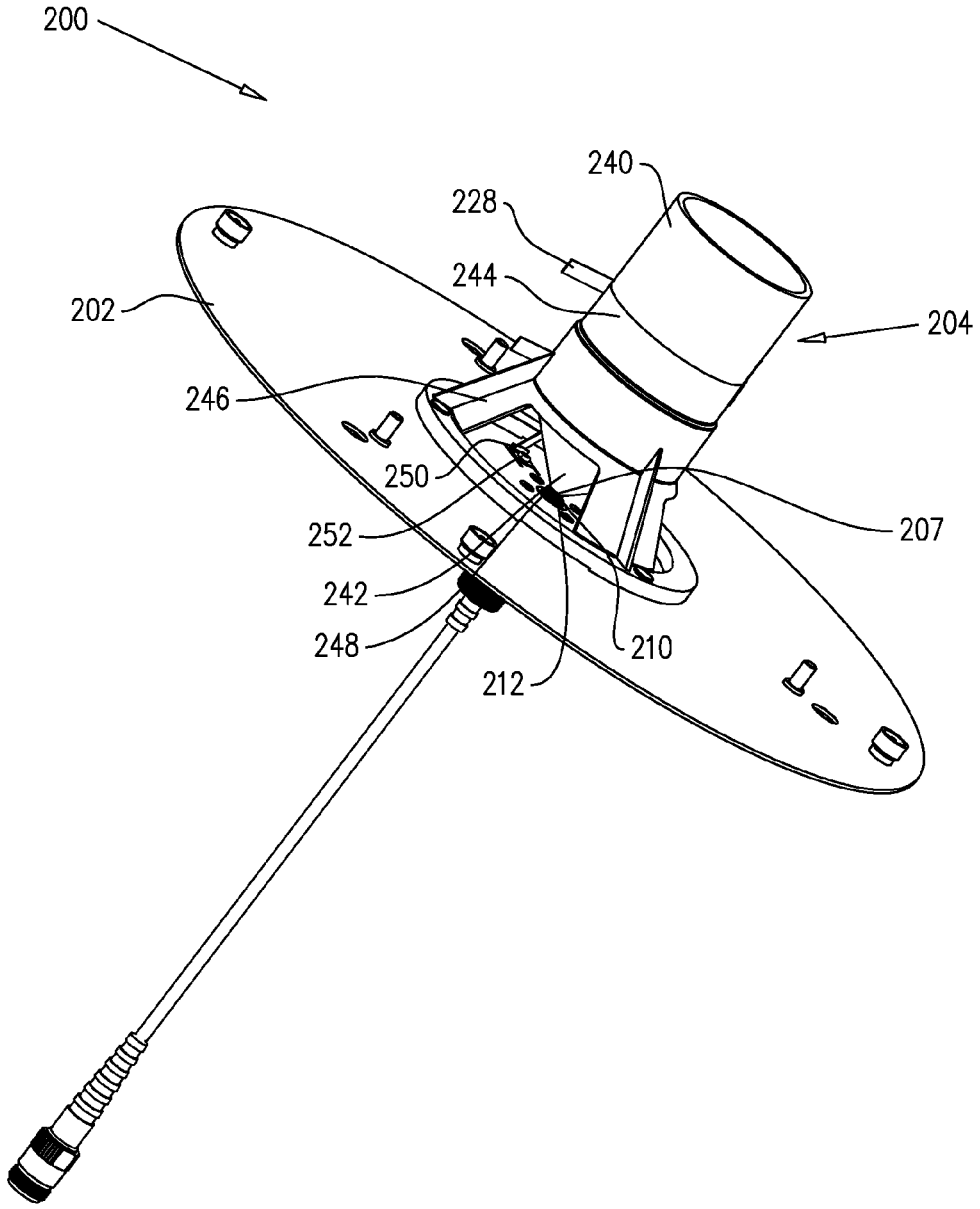

Reference is now made to FIGS. 2A-2C, which are simplified respective side, top and perspective view illustrations of an antenna constructed and operative in accordance with another preferred embodiment of the present invention.

As seen in FIGS. 2A-2C, there is provided an antenna 200 preferably including a ground plane 202 and a broadband radiating element 204 mounted thereon. Broadband radiating element 204 is preferably embodied as a broadband vertically polarized conical monopole radiating element 204, preferably disposed on a surface 206 of ground plane 202.

Broadband radiating element 204 includes a feed point 207, at which feed point 207 broadband radiating element 204 is preferably fed by way of a feed 208. As seen most clearly in FIG. 1C, feed 208 preferably comprises an input port 210 preferably galvanically connected to feed point 207 by way of an aperture 212 formed in ground plane 202. It is appreciated, however, that the illustrated arrangement of feed 208 with respect to broadband radiating element 204 is exemplary only and that other suitable feed arrangements, as are well known in the art, may alternatively be implemented in antenna 200.

As will be readily understood by one skilled in the art, feed point 207 of broadband radiating element 204 has an associated first impedance and feed 208 has an associated second impedance, which first and second impedances must be mutually well matched in order to facilitate efficient energy transfer therebetween and hence allow broadband operation of antenna 200. It is a particular feature of a preferred embodiment of the present invention that the first impedance of feed point 207 is well matched to the second impedance of the feed 208 due to the provision of a ground leg 220 extending between broadband radiating element 204 and ground plane 202. As seen most clearly at enlargement 222 in FIG. 2A, ground leg 220 preferably has a first end 224, which first end 224 is preferably connected to broadband monopole radiating element 204, and a second end 226, which second end 226 is preferably connected to ground plane 202.

It is a further particular feature of a preferred embodiment of the present invention that ground leg 220 is preferably arranged so as to be capacitively coupled to broadband radiating element 204. As seen most clearly in FIG. 2A, ground leg 220 is preferably located in close proximity to and co-extensive with a portion of broadband radiating element 204, thereby leading to capacitive coupling therebetween. This is in contrast to conventional ground leg matching arrangements, in which the ground leg typically performs impedance matching by way of providing a shunt conductive path between a radiating element and a ground, but does not itself capacitively couple to the radiating element.

As a result of the capacitive coupling between broadband radiating element 204 and ground leg 220, ground leg 220 is functional to significantly improve the impedance match of broadband radiating element to the feed 208 and hence facilitates ultra-broadband operation of radiating element 204. By way of example only, broadband radiating element 204 may operate over an ultra-broadband frequency range of 380-6000 MHz due to the improved impedance matching provided by the capacitive coupling of ground leg 220 to broadband radiating element 204, whereas in the absence of capacitively coupled ground leg 220 radiating element 204 may have a more limited frequency range spanning only 700-6000 MHz. Ground leg 220 thus serves to create an additional resonant frequency range in antenna 200.

The capacitive coupling between ground leg 220 and broadband radiating element 204 is preferably optimized by way of a plurality of stubs 228 preferably extending outwards from ground leg 220. The strength of the capacitive coupling between ground leg 220 and broadband radiating element 204 may be adjusted by means of modifications to the location and geometry of stubs 228 and of ground leg 220, in accordance with the operating requirements of antenna 200. As seen most clearly at enlargement 222, ground leg 220 may be held in position with respect to broadband radiating element 204 by way of a non-conductive securing element 230. It is understood, however, that the particular configuration of ground leg 220 and stubs 228 shown in FIGS. 2A-2C is exemplary only.

Ground leg 220 is preferably intersected by at least one lumped reactive element, here embodied, by way of example, as an inductive coil 232. Coil 232 is preferably serially disposed within ground leg 220 between first and second ends 224 and 226 thereof. It is appreciated, however, that coil 232 may be disposed at any point, serially or in parallel, along ground leg 220 in accordance with the mechanical design requirements of ground leg 220. It is further appreciated that ground leg 220 may comprise discrete elements bridged by at least one reactive element, as shown in FIGS. 2A-2C, or may be formed as a continuous structure. The at least one reactive element disposed within ground leg 220 may, by way of example, alternatively comprise an inductor and a capacitor.

Coil 232, in combination with the capacitive coupling provided by capacitively coupled ground leg 220, is functional to reduce the VSWR of antenna 200. By way of example only, antenna 200 may operate with a VSWR of less than 2:1 over a frequency range of 1700-1900 MHz, due to the presence of coil 232 in capacitively coupled ground leg 220. In the absence of coil 232, antenna 200 may operate with a VSWR of greater than 1.7:1 in the 1700-1900 MHz frequency range. Coil 232 may have an inductance value of approximately 12 nH.

In the embodiment of antenna 200 shown in FIGS. 2A-2C, ground leg 220 is shown to be galvanically connected at its first and second ends 224 and 226 to broadband radiating element 204 and ground plane 202 respectively. It is appreciated, however, that ground leg 220 may alternatively be capacitively connected at one or both of its ends to broadband radiating element 204 and ground plane 202 respectively, depending on the impedance matching required to be performed by ground leg 220.

It is thus appreciated that due to the enhanced impedance matching performed by capacitively coupled ground leg 220 including coil 232, antenna 200 constitutes an ultra-broadband vertically polarized antenna capable of radiating vertically polarized RF signals over an extremely wide frequency range, making antenna 200 particularly well suited for a wide variety of SISO applications. Broadband radiating element 204 preferably radiates a conical, omnidirectional radiation pattern.

Antenna 200 may be installed on an indoor or outdoor surface. A multiplicity of holes 234 is optionally formed in ground plane 202 in order to facilitate the attachment of antenna 200 to a supporting surface such as a ceiling or wall. Holes 234 may also be used for the optional attachment of a radome to antenna 200.

In accordance with a particularly preferred embodiment of the present invention, broadband vertically polarized conical monopole radiating element 204 preferably comprises an upper conductive cylindrical element 240 and a lower conductive conical element 242. Cylindrical element 240 and conical element 242 are preferably held in a partially overlapping configuration by means of an inner dielectric spacer element 244 and outer supporting dielectric stand 246, as seen most clearly in FIG. 2C. Feed point 207 is preferably located at an apex 248 of lower conductive conical element 242. Broadband vertically polarized conical monopole radiating element 204 is preferably generally of a type described in Chinese Utility Model Application No. 201320043587.5, assigned to the same assignee as the present application and incorporated herein by reference.

It is appreciated, however, that the illustrated embodiment of monopole radiating element 204 is exemplary only and that a variety of other broadband monopole radiating elements are possible and are included in the scope of the present invention. It is further appreciated that the terms 'upper' and 'lower' as used with respect to the relative location of cylindrical and conical elements 240 and 242 are relational only and that the spatial relationship between cylindrical and conical elements 240 and 242 is determined by the orientation at which antenna 200 is mounted.

Further in accordance with a particularly preferred embodiment of the present invention, ground leg 220 preferably comprises a first square portion 250 disposed on ground plane 202 and preferably secured thereto by way of a screw 252. A second tapered portion 254 preferably extends from first square portion 250 at an acute angle with respect to a first plane defined by ground plane 202. Second tapered portion 254 preferably bends at an acute angle to form a third portion 256, which third portion 256 preferably extends generally parallel to lower conductive conical element 242. Third portion 256 preferably terminates in a short fourth portion 258, which short fourth portion 258 preferably lies in a second plane parallel to the first plane and offset therefrom.

A fifth elongate portion 260 preferably extends perpendicularly from fourth portion 258. A first protrusion 262 and a second protrusion 264 preferably extend perpendicularly at intervals along fifth elongate portion 260 and parallel to each other. Fifth elongate portion 260 further preferably includes an orthogonally bent terminal section 266. It is appreciated that first and second protrusions 262 and 264 constitute particularly preferred embodiments of stubs 228.

A sixth portion 268 preferably extends parallel to and offset from terminal section 266. Sixth portion 268 forms an extruding end segment of a seventh inverted L-shaped portion 270, which seventh inverted L-shaped portion 270 is preferably supported by an outer wall 272 of upper conductive cylindrical element 240.

An inductive coil 274 preferably bridges orthogonally bent terminal section 266 and sixth portion 268. Coil 274 is secured by way of two conductive legs 276 respectively inserted into orthogonally bent terminal section 266 and sixth portion 268. It is appreciated that coil 274 is a particularly preferred embodiment of coil 232.

Figure 3A:
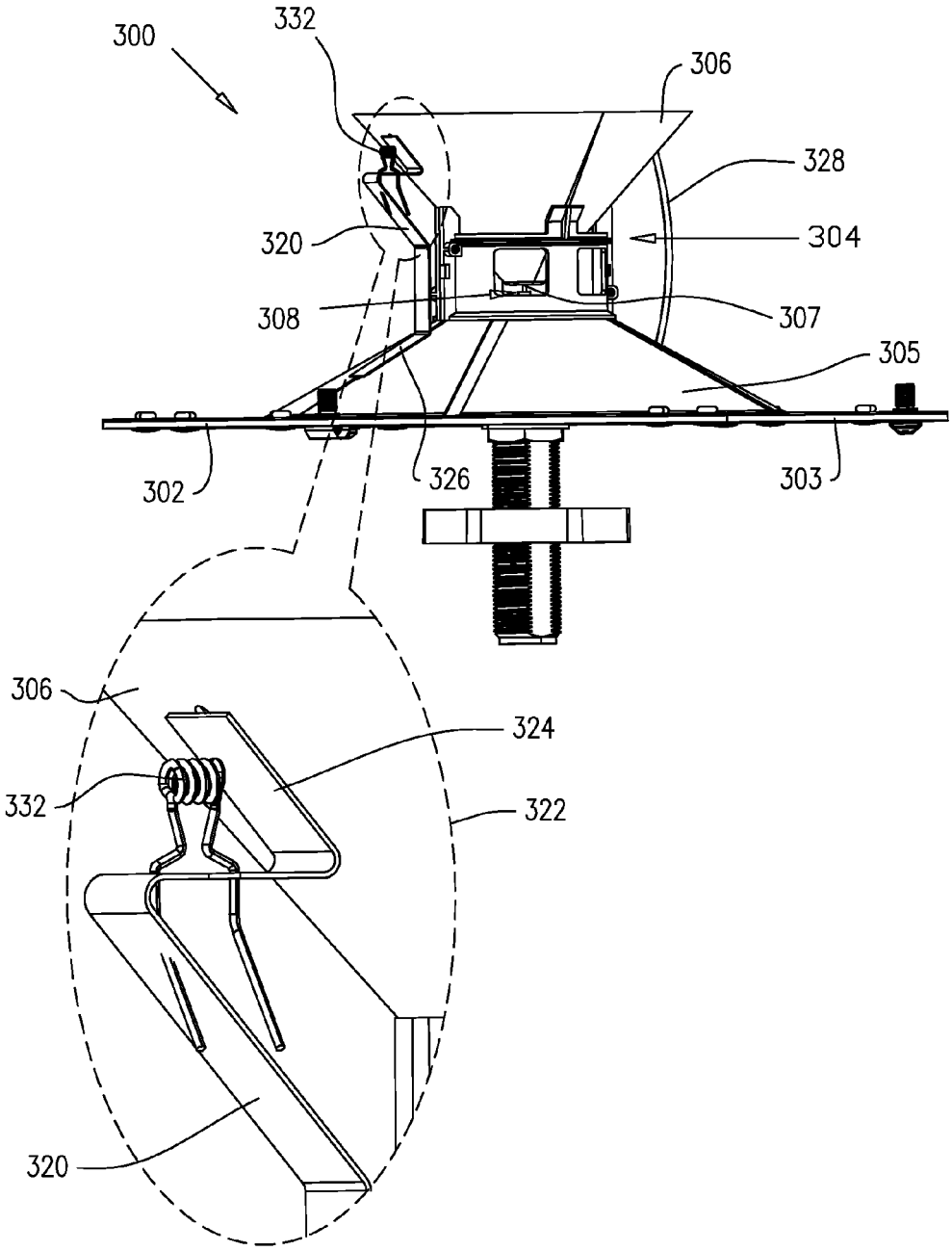
FIGS. 3A, 3B and 3C are simplified respective side, top and perspective view illustrations of an antenna constructed and operative in accordance with a further preferred embodiment of the present invention.
Figure 3B:
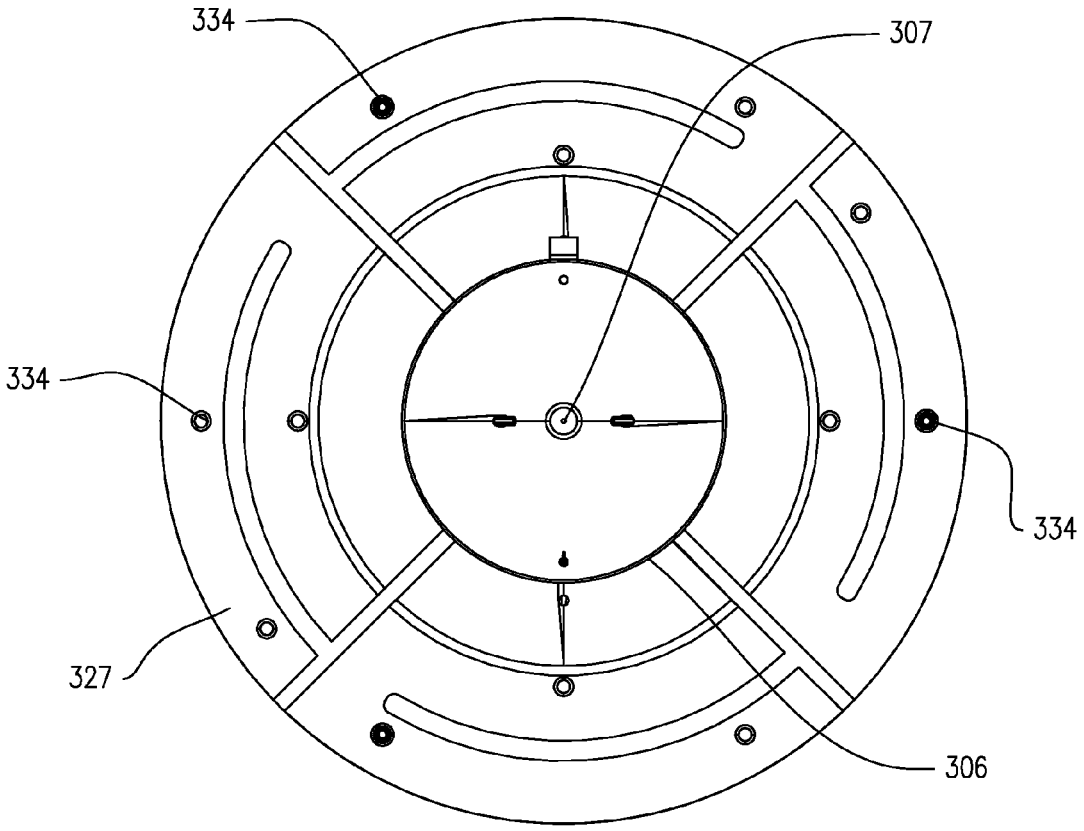
Figure 3C:
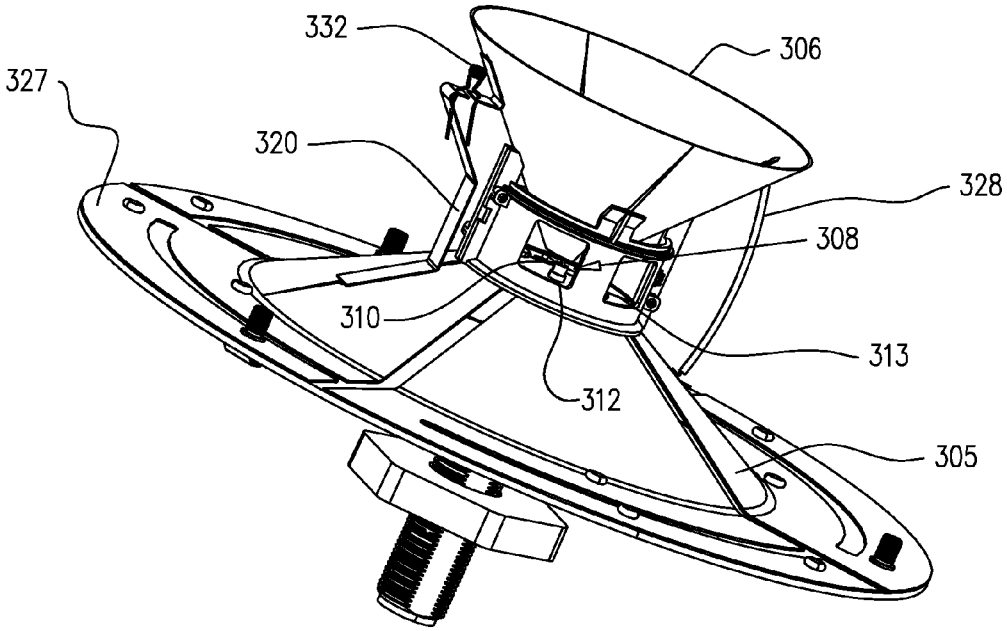

Reference is now made to FIGS. 3A-3C, which are simplified respective side, top and perspective view illustrations of an antenna constructed and operative in accordance with a further preferred embodiment of the present invention.

As seen in FIGS. 3A-3C, there is provided an antenna 300 preferably including a ground plane 302 formed by a reflector element 303, and a broadband radiating element 304 mounted thereon. Broadband radiating element 304 is preferably embodied as a broadband bi-conical radiating element 304, preferably comprising a first generally conical radiating element 305 and a second generally conical radiating element 306 mounted thereon. First generally conical radiating element 305 of broadband radiating element 304 is preferably disposed on a surface of ground plane 302. Broadband radiating element 304 is preferably generally of a type described in Chinese Utility Model Application No. 201220742903.3, assigned to the same assignee as the present application and incorporated herein by reference.

Broadband radiating element 304 preferably includes a feed point 307, preferably located at a truncated apex of second generally conical radiating element 306. Broadband radiating element 304 is preferably fed at feed point 307 by way of a feed 308. As seen most clearly in FIG. 3C, feed 308 preferably comprises an input port 310 preferably galvanically connected to feed point 307 by way of an aperture 312 formed in a truncated apex portion 313 of first generally conical radiating element 305. It is appreciated, however, that the illustrated arrangement of feed 308 with respect to broadband radiating element 304 is exemplary only and that other suitable feed arrangements, as are well known in the art, may alternatively be implemented in antenna 300.

As will be readily understood by one skilled in the art, feed point 307 of broadband radiating element 304 has an associated first impedance and feed 308 has an associated second impedance, which first and second impedances must be mutually well matched in order to facilitate efficient energy transfer therebetween and hence allow broadband operation of antenna 300. It is a particular feature of a preferred embodiment of the present invention that the first impedance of feed point 307 is well matched to the second impedance of the feed 308 due to the provision of a ground leg 320 extending between broadband radiating element 304 and ground plane 302. As seen most clearly at enlargement 322 in FIG. 3A, ground leg 320 preferably has a first end 324, which first end 324 is preferably connected to second generally conical radiating element 306. Ground leg 320 preferably has a second end 326, which second end 326 is preferably connected to first generally conical radiating element 305. First generally conical radiating element 305 preferably includes a meandered counterpoise portion 327 disposed on ground plane 302.

It is a further particular feature of a preferred embodiment of the present invention that ground leg 320 is preferably arranged so as to be capacitively coupled to broadband radiating element 304. As seen most clearly in FIGS. 3A and 3C, ground leg 320 is preferably located in close proximity to and co-extensive with a portion of broadband radiating element 304, thereby leading to capacitive coupling therebetween. This is in contrast to conventional ground leg matching arrangements, in which the ground leg typically performs impedance matching by way of providing a shunt conductive path between a radiating element and a ground, but does not itself capacitively couple to the radiating element. Additional conventional matching elements, such as a gamma matching element 328, may optionally be included in antenna 300 in order to further improve impedance matching.

As a result of the capacitive coupling between broadband radiating element 304 and ground leg 320, ground leg 320 is functional to significantly improve the impedance match of broadband radiating element to the feed 308 and hence facilitates ultra-broadband operation of radiating element 304, by way of creating an additional resonant frequency range in antenna 300.

Ground leg 320 is preferably intersected by at least one lumped reactive element, here embodied, by way of example, as an inductive coil 332. Coil 332 is preferably disposed in parallel with ground leg 320 between first and second ends 324 and 326 thereof. It is appreciated, however, that coil 332 may be disposed at any point, serially or in parallel, along ground leg 320 in accordance with the mechanical design requirements of ground leg 320. It is further appreciated that ground leg 320 may comprise a continuous structure, as illustrated in FIGS. 3A-3C, or may comprise discrete elements bridged by at least one reactive element. The at least one reactive element disposed in parallel with ground leg 320 may, by way of example, comprise an inductor and a capacitor. Coil 332, in combination with the capacitive coupling provided by capacitively coupled ground leg 320, is functional to reduce the VSWR of antenna 300.

In the embodiment of antenna 300 shown in FIGS. 3A-3C, ground leg 320 is shown to be galvanically connected at its first end 324 to broadband radiating element 304. It is appreciated, however, that ground leg 320 may alternatively be capacitively connected at its first end 324 to broadband radiating element 304, depending on the impedance matching required to be performed by ground leg 320.

It is thus appreciated that due to the enhanced impedance matching performed by capacitively coupled ground leg 320 including coil 332, antenna 300 constitutes an ultra-broadband vertically polarized antenna capable of radiating vertically polarized RF signals over an extremely wide frequency range, making antenna 300 particularly well suited for a wide variety of SISO applications. Broadband radiating element 304 preferably radiates a conical, omnidirectional radiation pattern.

Antenna 300 may be installed on an indoor or outdoor surface. A multiplicity of holes 334 is optionally formed in ground plane 302 and meandered counterpoise portion 327 in order to facilitate the attachment of antenna 300 to a supporting surface such as a ceiling or wall. Holes 334 may also be used for the optional attachment of a radome to antenna 300.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

a ground plane;

a broadband radiating element mounted on said ground plane and comprising a feed point, said feed point having a first impedance;

a feed for feeding said broadband radiating element at said feed point, said feed having a second impedance; and a ground leg extending between and galvanically connecting said broadband radiating element and said ground plane for impedance matching said first impedance to said second impedance, said ground leg arranged proximate to a portion of said broadband radiating element to capacitively coupled to said portion of said broadband radiating element, wherein said broadband radiating element comprises a broadband vertically polarized conical monopole radiating element, wherein said broadband vertically polarized conical monopole radiating element comprises:

an upper conductive cylindrical element;

a lower conductive conical element partially overlapping with said upper conductive cylindrical element, said lower conductive conical element having an apex, said feed point being located at said apex;

an inner dielectric spacer element supporting said upper conductive cylindrical element; and an outer supporting dielectric stand supporting said upper conductive cylindrical element and said lower conductive conical element, and wherein said ground leg comprises:

a first square portion disposed on said ground plane and preferably secured thereto by way of a screw;

a second tapered portion extending from said first square portion at an acute angle with respect to a first plane defined by said ground plane;

a third portion extending from said second tapered portion and bent at an acute angle thereto, said third portion being generally parallel to said lower conductive conical element and terminating in a short fourth portion, said short fourth portion lying in a second plane parallel to said first plane and offset therefrom;

a fifth elongate portion extending perpendicularly from said fourth portion and comprising a first protrusion and a second protrusion extending perpendicularly therefrom, said first and second protrusions being spaced at intervals along said fifth elongate portion and being mutually parallel, said fifth elongate portion also comprising an orthogonally bent terminal section;

a sixth portion extending parallel to and being offset from said orthogonally bent terminal section, said sixth portion forming an extruding end segment of a seventh inverted L-shaped portion, said seventh inverted L-shaped portion being supported by an outer wall of said upper conductive cylindrical element; and a capacitor bridging said orthogonally bent terminal section and said sixth portion, said capacitor being secured by way of two conductive legs respectively inserted in said orthogonally bent terminal section and said sixth portion.

2. An antenna according to claim 1, wherein said ground plane comprises an aperture adapted for insertion therethrough of said feed.

3. An antenna according to claim 2, wherein said feed is galvanically connected to said feed point of said broadband radiating element.

4. An antenna according to claim 1, wherein said ground leg comprises a first end and a second end, said first end being connected to said broadband radiating element and said second end being connected to said ground plane.

5. An antenna according to claim 4, and also comprising at least one lumped reactive element disposed within said ground leg.

6. An antenna according to claim 5, wherein said at least one lumped reactive element is serially disposed within said ground leg.

7. An antenna according to claim 5, wherein said at least one lumped reactive element comprises a capacitor.

8. An antenna according to claim 5, wherein said at least one lumped reactive element comprises an inductive coil.

9. An antenna according to claim 5, wherein said broadband radiating element operates over a frequency range of 380-6000 MHz.

10. An antenna according to claim 1, wherein said ground leg comprises protruding stubs.

11. An antenna according to claim 1, wherein the capacitive coupling between said ground leg and said broadband radiating element is functional to match said first impedance to said second impedance.

12. An antenna according to claim 11, wherein said capacitive coupling is functional to reduce a voltage standing wave ratio of said antenna.

* * * * *